United States Patent [19]

Liedtke

[11] 3,986,258

[45] Oct. 19, 1976

[54] HAIRCUTTER

[75] Inventor: Christa Liedtke, Essen, Germany

[73] Assignee: Dieter W. Liedtke, Germany

[22] Filed: May 2, 1974

[21] Appl. No.: 466,119

[30] Foreign Application Priority Data

| | | |
|---|---|---|
| May 3, 1973 | Germany | 7316625[U] |
| July 17, 1973 | Germany | 7326195[U] |
| Aug. 11, 1973 | Germany | 7329443[U] |
| Dec. 3, 1973 | Germany | 7342977[U] |

[52] U.S. Cl. ..... 30/30; 30/233.5

[51] Int. Cl.[2] ..... B26B 21/16; B26B 21/42

[58] Field of Search ..... 30/30, 31, 200, 201, 30/233.5

[56] References Cited

UNITED STATES PATENTS

| | | | |
|---|---|---|---|
| 1,471,970 | 10/1923 | McElroy | 30/30 |
| 2,237,676 | 4/1941 | Lewis | 30/30 |
| 2,291,439 | 7/1942 | Andis | 30/200 |
| 2,746,144 | 5/1956 | Spanel | 30/31 |
| 3,387,367 | 6/1968 | Merzon | 30/201 |

*Primary Examiner*—Al Lawrence Smith
*Assistant Examiner*—Gary L. Smith
*Attorney, Agent, or Firm*—Allison C. Collard

[57] ABSTRACT

A hair cutter comprising a blade interchangeably retained between a blade-supporting plate and a cover plate, the latter having a row of teeth which overlaps said blade cutting edge. The plates are displaceable perpendicularly to the blade cutting edge and relatively to one another between two end positions, and the blade-supporting plate bears the blade as far as adjacent the cutting edge, yet leaving the blade cutting edge exposed. In a zone adjoining the blade cutting edge, the blade-supporting plate has at least in part a wedge-shaped portion increasing in thickness extending from the blade cutting edge in a rearward direction, so that when the hair cutter is placed on the head of the user the blade is adjustable to a cutting angle determined by front ends of the teeth and application portions of the wedge-shaped portion on the user's head. A coupling member is disposed on each of the two plates for locating the plates with respect to one another in selectable displacement positions and a spring retains the coupling members with prestressing in positive engagement with one another, an actuating element extending through one of the two plates and being accessible from an outside, and movably retained perpendicularly to the plane of the blade, and engaging with one of the coupling members and disengaging the latter on actuation against the spring.

13 Claims, 20 Drawing Figures

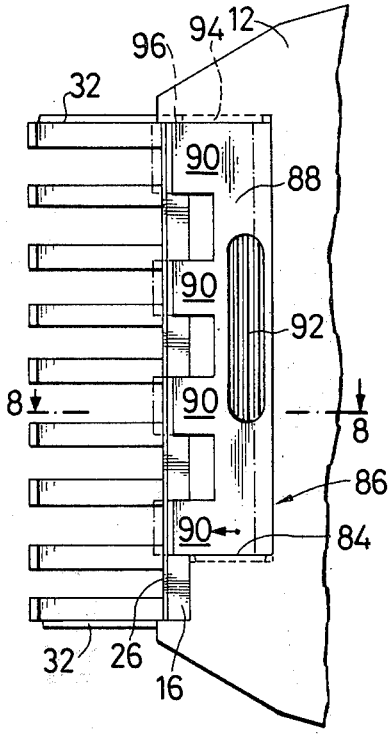
Fig. 7
Fig. 8
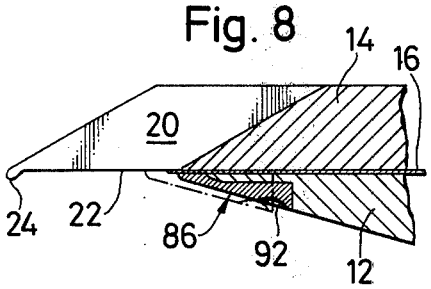
Fig. 9
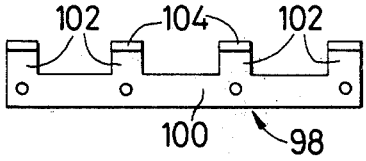
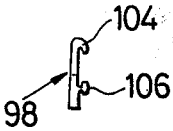
Fig. 10
Fig. 6
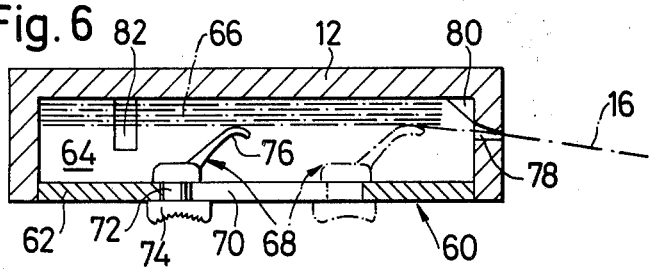

HAIRCUTTER

The present invention relates to a hair cutter having at least one blade interchangeably retained between a blade-supporting plate and a cover plate, the cover plate which has a row of teeth which overlap the blade cutting edge, orientates the hair seized when drawn through the hair, in the manner of a comb, in the working direction - i.e., perpendicularly to the blade cutting edge, the cover plate and blade-supporting plate being displaceable perpendicularly to the blade cutting edge and relatively to one another between two end positions, the blade-supporting plate bearing the blade as far as the vicinity of the cutting edge, but leaving the cutting edge exposed.

Hair cutters are known in which one or more blades are inserted between a blade-supporting plate and a cover plate, and parallel with the cutting edges of the blades there project from the blade-retaining plates, rows of teeth whose length projecting beyond the blade cutting edge determines the length to which the hair is cut. In the case of cutters having a number of blades the length of the teeth in the row is as a rule invariable, although rows of teeth associated with different blades have different lengths. With these cutters, therefore, a row of teeth suitable for the required length to which the hair is to be cut must be chosen.

In the case of cutters which operate with only one blade, as a rule one of the plates is so disposed displaceably in relation to the other plate such that the length to which the row of teeth is disposed on the displaceable plate extend beyond the cutting edge and can be altered. To adjust the cutting angle of the plate cutting edge, the rear sides of the teeth remote from the blade have corresponding guide surfaces. These surfaces, when the cutter is applied to them, determine the cutting angle and the distance of the cutting edge from the guide surface, and therefore the length to which the hair is cut. However, it has been found that the cutting effect is relatively poor, due to the partial overlapping of the cutting edge by the projecting teeth. Moreover, the prior art cutters must be turned over, at least for shaving, and used from the rear side, since when adjusted for hair cutting, the teeth cannot be retracted so far as behind the blade cutting edge.

Furthermore, as a rule it is not enough to shorten the hair as a whole in order to produce a clean hair-cut with satisfactory transitions, but the hair must be partly thinned to a greater or lesser extent, in dependence on the individual growth.

It is an object of the present invention to construct a hair cutter of the above-mentioned type such that it can be such adjusted by simple means for all cutting lengths, including shaving, and can be used in one single working position. It is also impossible for the blade cutting edge to cause injuries even when the cutter is used for shaving.

Accordingly, in accordance with the present invention, in the zone adjoining the cutting edge of the blade, the blade-supporting plate is constructed, increasingly thicker in the fashion of a wedge, starting from the cutting edge and extending in the rearward direction, so that when the cutter is placed on the head of the user, the blade is adjusted to a cutting angle determined by the front ends of the teeth of the cover plate and the application surface or points of the wedge-shaped thickened portion on the user's head. On each of the two plates, in order to locate them in relation to one another in selectable displacement positions, there are disposed coupling members which are retained prestressed by a spring in positive engagement with one another, and an actuating element, extending through one of the two plates, accessible from outside, and retained with provision for movement perpendicularly to the plane of the blade, and engages with one of the coupling members and disengages it on actuation against the spring prestressed from the other coupling member.

The fact that the blade cutting edge is exposed on its underside adjacent the hair for all cutting length adjustments ensures a satisfactory cutting performance, since the user's hair is not forced away from the cutting edge by material of the blade-supporting plate. The construction of the cutter in the form of a progressively thicker wedge facilitates the guiding thereof, while providing an optimum cutting angle in relation to the hair, since the optimum cutting angle is automatically adjusted in any case when the cutter is placed on the user's hair. The adjustment of the length to which the hair is cut is obtained in a very simple manner by the actuating element, which is accessible from the outside and actuates the coupling member operative between the two plates.

In a preferred further development of the present invention, the teeth of the row of teeth of the cover plate are so constructed that their front edges, which project in the working direction over the blade cutting edge, engage when in the completely retracted end position (shaving position) in the cutting plane of the blade by at least its thickness in the zone lying immediately in front of the cutting edge. The fact that the cutting edge is overlapped in this way by the front end of the teeth substantially obivates the risk of injury to the user even when the cutter is used at the shaving stage, without any deterioration in the shaving effect.

The cutting length, more particularly of wavy or curly hair is evened out if the wedge-shaped thickened portion of the outside of the blade-supporting plate is formed by a plurality of slender pin or knob-like projections projecting from the blade-supporting plate, since such pin or knob-like projections penetrate into the hair. When the cutter is passed through the hair they exert thereon a tightening and decelerating effect, so that curly or wavy hair is pulled flat and seized in the required length by the cutting edge. Moreover, the projections also exert an extra advantageous massaging effect on the scalp, so that in addition to merely cutting the hair, the cutter also has a growth-encouraging effect. The massage brush-like projections also entrain cut-off loose hairs, so that there is no need to comb out the hair as usual to remove any remaining cut-off ends.

In an advantageous further development of the present invention, the actuating element, combined with one of the two coupling members to form an integral unit, is retained on the blade-supporting plate and prestressed by a spring in the lifting direction of the blade-supporting plate, and the coupling member combined with the actuating element is formed by two attachments projecting laterally of the actuating element and engaging via catch projections in recesses of the complementary shape between catch projections on the inside of the cover plate, and the actuating element extends through a slot in the cover plate extending in the direction of displacement.

In order to deal with the problem of providing spare blades when the working blade has become blunt, according to a further feature of the present invention, one of the two plates of the cutter is provided with a blade dispenser receiving a stack of spare blades, the dispenser taking the form of a cavity which can be closed by a cover and is adapted to the dimensions of the stack of blades. The blade dispenser can therefore be refilled and spare blades removed without opening the cutter.

The problem of thinning out the hair is solved according to the present invention by the feature that those zones of the cutting edge of the blade lying in the gaps between the teeth of the hair cutter can be partially covered or put out of operation at choice, by covering elements disposed fixed or releasably on the hair cutter.

According to another feature of the present invention, the covering elements can be rendered operative and inoperative by the transverse or longitudinal displacement of a structural part slidably mounted in the hair cutter.

Even hair cutters in which the teeth project fixedly beyond the blade cutting edge can be so constructed that they can be used at choice for shortening or thinning out the hair.

The covering elements are formed by the cutting edge of the blade and are so screened against the entry of hair in one portion of the gaps between the teeth such that only that part of the hair which is seized by the unscreened cutting edge zones is shortened, but the remainder of the hair is not shortened. The interchangeable blade, having in known manner two cutting edges or a set of interchangeable blades comprising two blades, is provided and such that the blade can be so inserted, with regard to its two cutting edges, or one of the two blades of the set of blades can be so inserted at choice in the cutter, such that the cutting edges intended for shortening the hair can be adjusted to a cutting position exposing at all the gaps between the teeth of the row of teeth, beside the position screened in individual zones.

Other objects and features of the present invention will become apparent from reference of the drawings, which disclose several embodiments of the present invention, and of which FIG. 1 is a perspective view of a preferred embodiment of the hair cutter according to the present invention;

FIG. 6 is a sectional view, taken along the line 6—6 in FIG. 2;

FIG. 7 is a partial view of the front part of a hair cutter according to the present invention, viewed in the direction indicated by the arrow 7 in FIG. 1;

FIG. 8 is a sectional view, taken along the line 8—8 in FIG. 7;

FIG. 9 is a plan view from below of a detachable cutting edge attachment;

FIG. 10 is a side view of the cutting edge attachment shown in FIG. 9;

Figure 15:
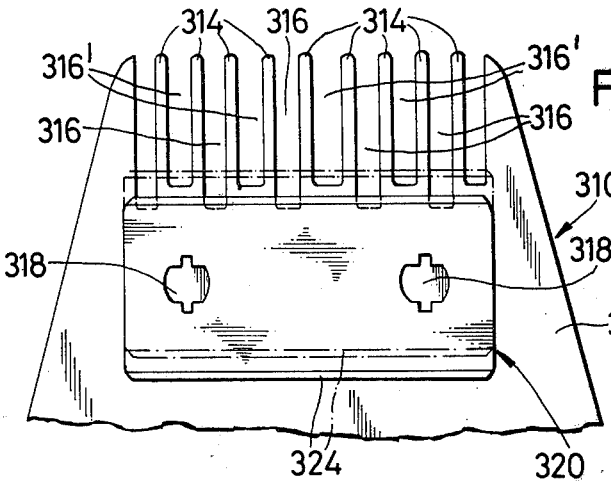
FIG. 15 is a partial plan view of a further embodiment of a hair cutter for optional thinning or shortening of the hair, the associated blade being shown both in the thinning and hair cutting (chain-dot lines) position.
Figure 17A:
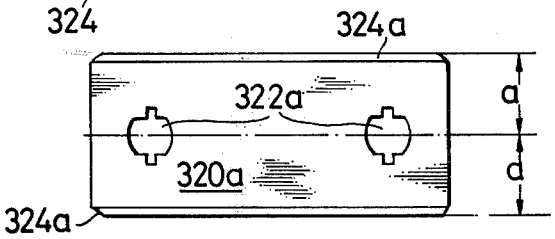
Figure 17B:
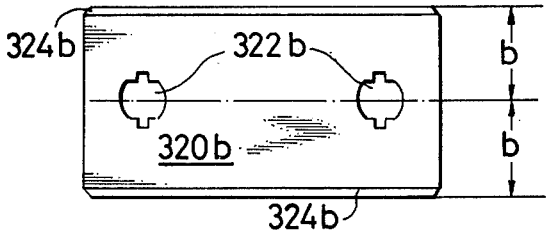
Figure 18:
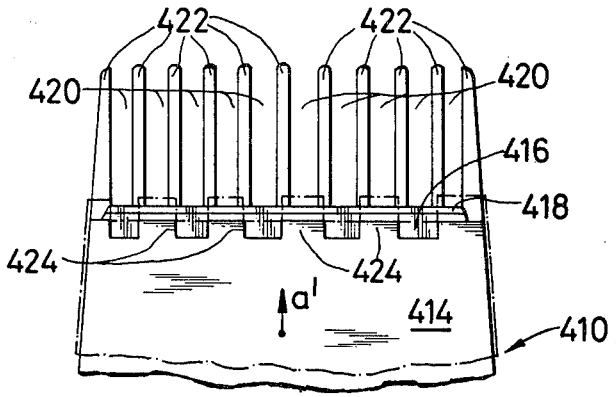
Figure 19:
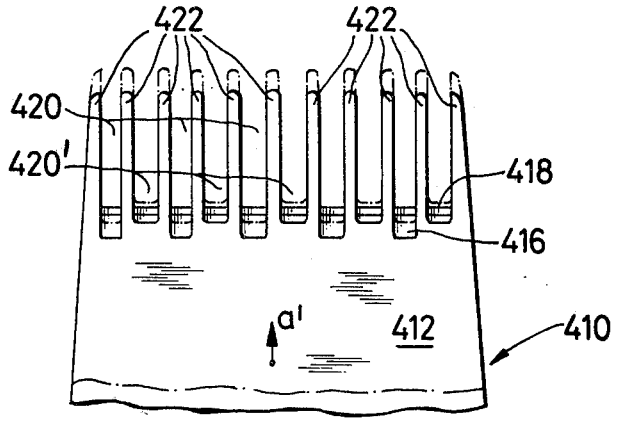

FIGS. 17*a* and 17*b* show two blades of a set of blades which can be used alternatively in the hair cutter illustrated in FIG. 15;

FIG. 18 is a partial plan view of the underside of a further embodiment of the hair cutter according to the present invention, in which the plate opposite the plate having the row of teeth is constructed displaceably in relation to the blade; and FIG. 19 is a partial plan view of the top side of a variant of the hair cutter according to the present invention illustrated in FIG. 18, in which a plate bearing the row of teeth can be displaced relatively to the blade.

Figure 1:
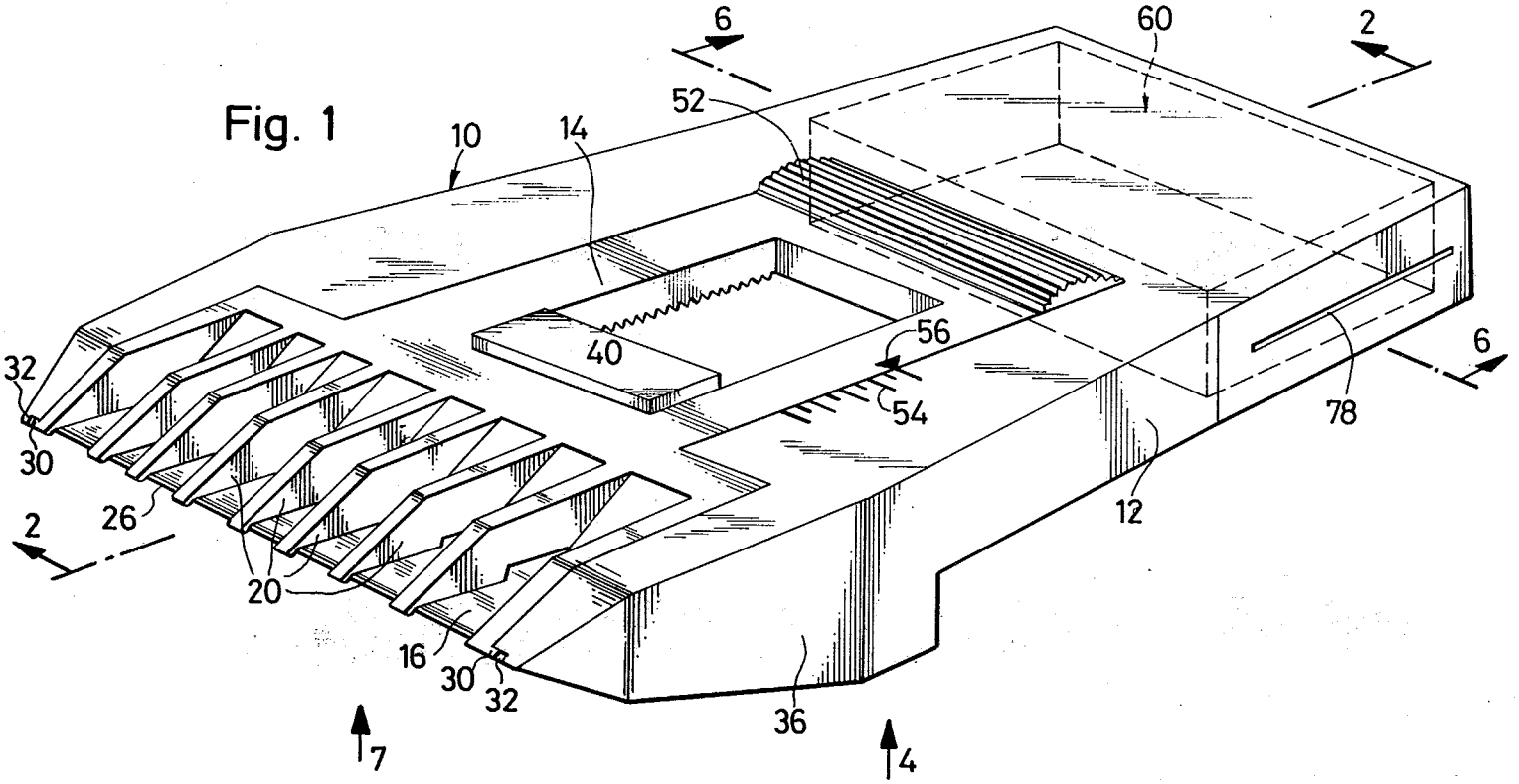
Figure 2:
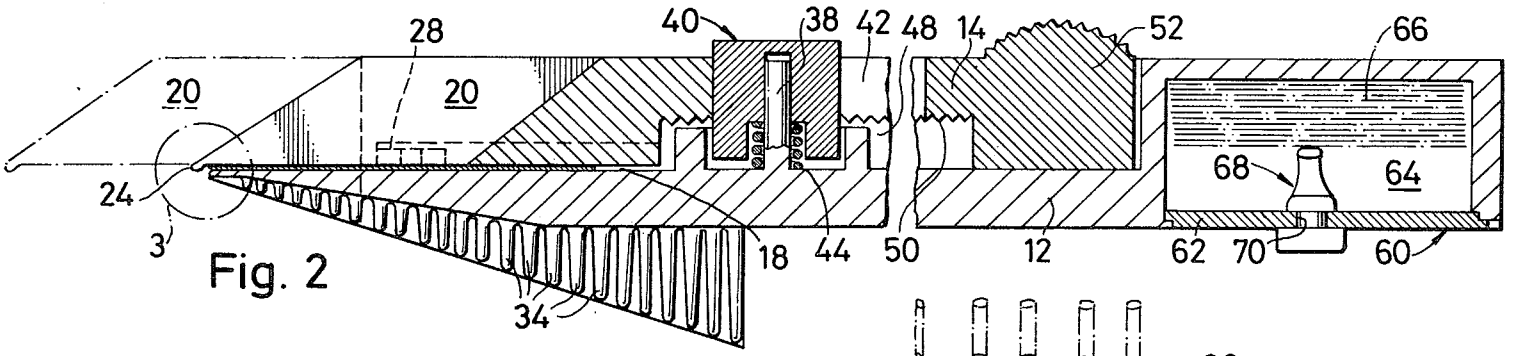
FIG. 2 is a sectional view, taken in the direction indicated by the arrows 2—2 in FIG. 1.

With reference now to the drawings, the hair cutter 10 illustrated in FIGS. 1 and 2 mainly comprises a blade-supporting plate 12 and a cover plate 14 between whose adjacent flat sides a blade 16 is disposed. The elongated blade-supporting plate 12 has a depression, corresponding to the outline shape of the cover plate 14, open on the front side and having a flat bottom 18 whose depth is equal to the thickness of the cover plate 14. The cover plate 14 is T-shaped in plan, a row of teeth 20 projecting integrally in one piece from its top transverse web. The front sides of the relatively narrow spaced-out teeth 20 are so chamfered that they cooperate with a flat tooth underside 22 resting on the blade 16 to form a pointed tooth front edge 24 which readily penetrates the user's hair when the cutter 10 is used.

The blade 16 is so retained on the bottom 18 of the recess in the blade-retaining plate 12 such that its cutting edge 26 projects somewhat beyond the front side of the blade-supporting plate 12. For the rigid bearing of the blade underside, the front side of the plate 12 is either advanced directly as far as the cutting edge, or at least has projections extending to the immediate vicinity of the cutting edge. The blade 16 is located on the bottom 18 of the blade-retaining plate 12 in conventional manner by two upwardly pointing pins 28 extending through complementary apertures in a blade 16 inserted in the cutter. The blade 16 lying on the bottom 18 is firmly pressed on to the bottom 18 in the zone of its cutting edge by the tooth underside 22 of the teeth 20 and in its rear zone by the underside of the cover plate 14, so that the blade is securely borne on both sides in the position of use. The essential thing is that the blade is borne on its underside by the blade-supporting plate as far as the immediate vicinity of the cutting edge 26, while the front edges 24 of the teeth 20 extend somewhat beyond the cutting edge 26 in any case - i.e., even in the completely withdrawn shaving position of the cover plate 14, illustrated in FIG. 1. The cover plate 14 can be displaced between two end positions in the working direction relatively to the blade-supporting plate 12. The inner end position of the cover plate, illustrated in FIGS. 1 and 2, is the position in which the cutter is used for shaving, for instance, the hair on the nape of the neck. The outer end position, shown in dot-dashed lines in FIG. 2, is on the other hand the cutting position, in which merely the long hair is shortened. The cutter can be adapted to any required length of hair cutting by adjustment to positions lying between the two end positions. The important thing is that in any case - i.e., even in the shaving position - the cutter is applied by the underside of the blade-supporting plate 12 to the hair to be cut, so that the user can never be in any doubt as to which side of the cutter must be used for the particular cutting purpose in view.

The cover plate is enabled to be displaced to change the projecting length of the teeth by a slideway which has a strip-shaped projection 30 extending on each of the lateral outer edges of the two outermost teeth 20 of the cover plate 14 in the direction of displacement as far as the tooth front edge, and a complementary groove 32 in the opposite side wall zone of the depression in each case. Since at their front edges these side wall zones merge into the two outer teeth of the cover plate 14, the cover plate is reliably guided as far as beyond the cutting edge 26 of the blade 16. The strip-shaped projections 30 are so arranged that the tooth undersides 22 and the underside of the cover plate 14 rest on the top side of the plate 16 with some pressure, with the result that the blade is firmly clamped with any adjustment of the teeth 20.

In its zone adjoining the blade cutting edge, the blade-supporting plate is constructed to become thicker after the fashion of a wedge, thus producing on the user's head a bearing surface which cooperates with the front edges 24 of the teeth 20 to ensure that the cutter is applied to the head at an optimum cutting angle. However, the wedge-shaped thickened portion of the outside of the blade-supporting plate 12 is not constructed in the zone behind the row of teeth in the form of a solid element which would compress the hair behind the blade cutting edge, but is divided up into a plurality of pin or knob-like projections 34, the length of which increases from the front side rearwardly, thus producing the required wedge shape. These projections, disposed either in regular rows or irregularly spaced out from one another, guide the hairs into the gaps, so that they are not compressed. However, when the projections are passed through the hair they exert a certain decelerating effect thereon, so that even wavy or curly hair is pulled smooth, thus causing the length to which the hairs are cut to be uniform. The cut-off ends of hair remain suspended between the projections, so that there is no need for the hair to be combed out after the cutter has been used. The projections 34, which are either made in one part with the blade-supporting plate 12 or made separately and applied, also exert an advantageous massaging effect on the scalp. As already mentioned, the pin-like projections are provided only in the width of the row of teeth, while the zones 36 adjoining laterally on both sides are integral with the material of the blade-supporting plate 12. As a result the cutter has a compact and appealing appearance. The wedge-shaped thickened portion extends only over about the front third of the cutter in length of about 2–3 cm.

Figure 3:
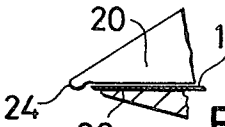
FIG. 3 is a partial sectional view of the front end of the hair cutter according to the present invention enclosed by the chain-dot circle 3 in FIG. 2.
Figure 4:
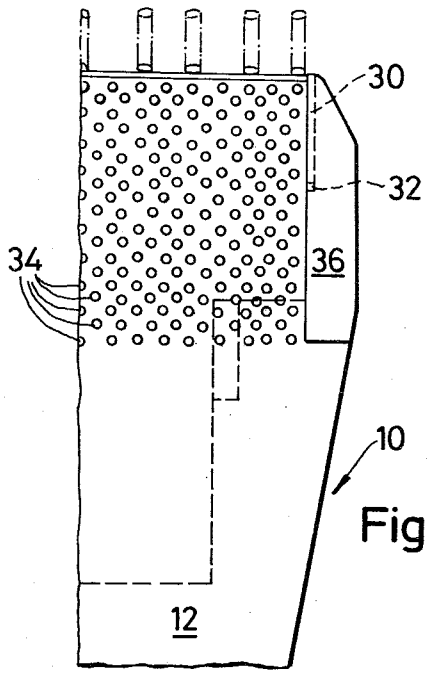
FIG. 4 is a broken away view, taken in the direction indicated by the arrow 4 in FIG. 1, of the underside of the hair cutter, only one half of the cutter being shown.
Figure 5:
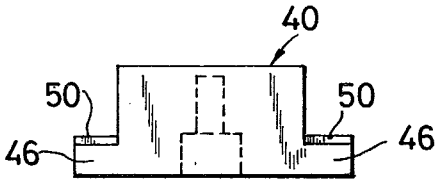
FIG. 5 is a front view of an actuating element of a catch device locating the cover plate in selectable positions in relation to the blade-supporting plate.

FIG. 3 is a partial sectional view of the front end of the cutter in the shaving position, the design of the front edge 24 of the teeth 20 being more particularly an essential feature. It can be seen that in their zone projecting beyond the cutting edge of the blade 16, the front edge of the teeth projects downwardly substantially by about the thickness of the blade, or somewhat more, so that the front edge 24 engages over the cutting edge. It can also be seen that the lower surface of the tooth front edge 24 applied to the user's scalp extends at an angle thereto corresponding substantially to the wedge angle of the underside of the blade-supporting plate 12. The tooth front edge is rounded. This step not only makes it impossible for injuries to be caused by the cutting edge of the blade 16 even in the shaving position, but also prevents the skin from being irritated by the front edges of the teeth 20.

For the adjustment of the length to which the hair is cut, a press-button-actuated catch device is provided which has a press-button-like actuating element 40 displaceably mounted on a pin 38 projecting from the bottom of the depression 18. The actuating element extends through a longitudinal slot 42 in the cover plate and is prestressed outwardly by a spring 44 bearing against the bottom 18 of the blade-supporting plate 12. The substantially rectangular actuating element has on two opposite sides projecting attachments 46 which engage below depressions 48 extending alongside the longitudinal slit 42 in the inner flat side of the cover plate 14. The top sides of the attachments 46, and those sides of the depressions 48 opposite such top sides, have tooth-like catch projections 50 of equal pitch. The spring 44 keeps the catch projections of the actuating element in engagement with the catch projections of the depression 48. However, by exerting a pressure on the top side of the actuating element and its consequent downward displacement such engagement can be cancelled out, so that the cover plate 14 can be displaced in relation to the blade-supporting plate 20. As soon as the pressure on the element 40 has been interrupted, the locking engagement is automatically restored by the spring prestressing. The spring prestressing tends to force the cover plate 14 away from the blade-supporting plate 12, within the clearance existing in the slideway 30, 32. Since the spring prestressing is operative beyond the inner end of the slideway remote from the cutting edge, the two plates move towards one another in a reaction movement in the zone of the cutting edge 16. The spring 44 therefore also firmly clamps the blade cutting edge between the cover plate and the blade-supporting plate.

In a variant embodiment (not shown) the actuating element 40 is in practice divided in a plane parallel with the plane of the blade. The press-button disposed above the dividing plane extends through a complementary aperture in the cover plate and can be displaced together therewith, while the second part of the actuating element, disposed below the dividing plane and representing the catch device, is constructed stationary and spring-loaded in the manner illustrated. One of the two parts of the actuating element must be so increased in size after the fashion of a skid in the dividing plane in the direction of displacement, that both parts bear against one another in every possible working position of the cover plate.

A raised and grooved handle 52 disposed on the rear end of the cover plate facilitates its displacement after the unlocking of the actuating element. If the aforementioned variant embodiment is used without a longitudinal slot in the cover plate, no separate handle is required, since in that case the press-button part displaceable together with the cover plate can also be used as the handle.

To indicate the adjustment of cutting length of the cutter 2, the blade-supporting plate has a graduated scale 54, opposite which there is an indicating mark 56 on the cover plate. If required, data (not shown) can also be associated with the divisions of the scale 54, providing information about the cut length adjustment.

Disposed in the rear portion of the blade-supporting plate 12 is a blade dispenser 60 (shown in dot-dashed lines) and constructed in the form of a cavity 64 which can be closed by a cover 62 and the length and width of which correspond substantially to the corresponding dimensions of a blade 16, while the depth of the cavity depends on the intended maximum number of blades 16 of a stack 66 of blades to be inserted in the blade dispenser 60. If required, enough space is also left above the stack 66 of blades to take a blade pusher 68 which will be described in greater detail hereinafter with reference to FIGS. 2 and 6.

The cover 62 closing the blade dispenser 60 bears against the underside of the blade-supporting plate 12 and takes the form of, for instance, a latchable hinged cover. In its central zone, the cover 62 is formed with a longitudinally extending slot 70 in which the blade dispenser is guided by a pin 72 extending outwards through the cover. On the outside of the cover, a push-button 74 engages over the pin 72, the push-button enabling the blade pusher 68 to be displaced in the direction of the slot 70 and at the same time locating the blade pusher in the cover. The blade pusher 68 has an arm 76 which projects from the blade pusher 68 in the direction of the bottom of the cavity 64 and rests with prestressing on the top blade 16 of a stack of blades inserted in the cavity 64. As a result, the stack of blades is pressed against the bottom of the cavity 64, and when the blade pusher is displaced, the arm 76 entrains the top blade 16 in the direction of a blade dispensing slot 78 in the side wall of the blade-supporting plate 12. The blade dispensing slot 78 is at a distance from the bottom of the cavity 64, substantially corresponding to the maximum height of the intended stack of blades. To ensure that even as the stack of blades increases in height the blades do not impinge against the inner boundary wall of the blade dispenser when the blade pusher 68 is actuated, but emerge through the blade dispensing slot 78, a short ramp 80, if necessary subdivided, is provided which extends starting from the bottom of the cavity 64 as far as the slot. Even when the height of the stack of blades is reduced, therefore, each top blade of the stack is guided over the ramp 80 to the blade dispensing slot 78 and then emerges therefrom.

A window 82 can be provided in the rear closure wall or the side wall of the blade-supporting plate 12, to enable the number of blades 16 still left in the stack 66 to be checked.

The construction of the blade dispenser 60 was described hereinbefore in connection with a special hair cutter 10 in which the length to which the hair is cut can be altered by changing the distance to which the teeth 20 overlap the cutting edge 26 of the working blade 16. However, the combination according to the present invention of a blade dispenser with a hair cutter is not limited to the cutter 10 described, but can be provided with any hair cutter whose basic member has space for a large enough cavity 64 of the dispenser 60. Since the dispenser is produced simultaneously with the cutter by the injection moulding process, and extra parts such as the cover, blade pusher and the like, just like the cutter itself, can be made from plastics, the cutter according to the present invention is only slightly more expensive to manufacture than the conventional cutters, whereas its utility is substantially enhanced.

FIGS. 7 and 8 illustrate those structural components of a further development of the cutter according to the present invention which enable it to be changed over optionally to normal cutting or thinning. The front and rear side of baseplate 12 are formed with a recess 84 into which a sliding member 86 is fitted which can be slid in the cutting direction from the rear end position, as shown in continuous lines, into the front end position, shown in chain-dot lines. The sliding member 86 comprises a number of pushers 90 interconnected by a transverse web 88 which are somewhat wider than the gap between two teeth 20 and are aligned alternately with each second gap. When the sliding member 86 is pushed forward into the position shown in dot-dashed lines, the pusher 90 covers a zone of the cutting edge 26 disposed in the gap between the teeth associated with such pusher, so that when the cutter is passed through the user's hair, the blade 16 cuts only in the gaps not covered by the pusher 90. Since the cover plate 14 and therefore the distance to which the teeth 20 overlap the blade 16 can be adjusted independently of the sliding member 86, a changeover can therefore be made to the thinning effect with any adjusted cutting length. A grooved handling depression 92 facilitates the sliding of the sliding member 86 which is guided on both sides in an associated groove 96 by a ledge or stri-shaped projection 94.

FIGS. 9 and 10 show a cutting edge attachment 98 which is separate from the hair cutter and in which projecting cutting edge attachments 102 are disposed each at a distance of two non-adjacent gaps between the teeth. The width of the attachments 102 is equal to the gap between the teeth, so that the attachments can be introduced by their bent front portions 104 over the cutting edge 26 of the blade 16 in every second gap between the teeth of the cutter 10. Head projections 106, which are indicated diagrammatically, can lock the member 98 in associated recesses in the baseplate 12 of the cutter 10.

Figure 11:
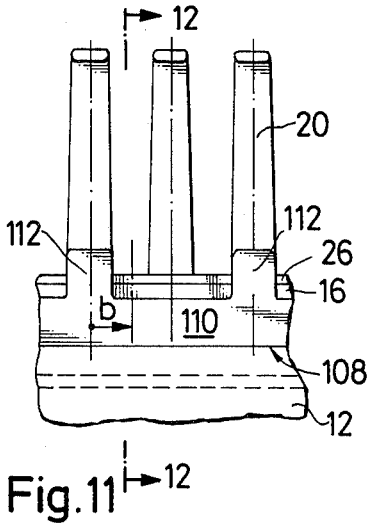
FIG. 11 is a partial view, enlarged in comparison with FIG. 7, of a further embodiment of a hair cutter according to the invention.
Figure 12:
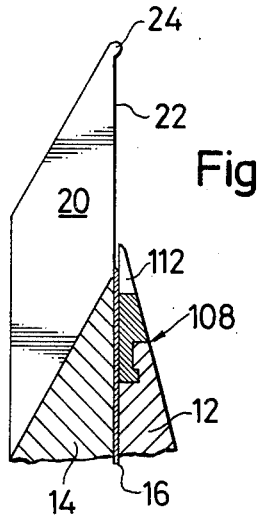
FIG. 12 is a sectional view, taken along the line 12—12 in FIG. 11.

FIGS. 11 and 12 illustrate a sliding member 108 which, unlike the embodiment illustrated in FIGS. 7 and 8, can be displaced in the transverse direction. The sliding member 108 comprises a transverse web 110 which can be displaced in the baseplate 12 in the transverse direction indicated by the arrow *b*. At a distance of every two teeth 20 the transverse web has forwardly pointing projections or lower teeth 112 which engage over the cutting edge 26 and can be adjusted by the transverse displacement of the sliding member 108 either in alignment with every tooth 20 (hair-cutting position) or in alignment with every gap between the teeth (thinning position). Even intermediate positions, such that the projections 112 overlap only part of the associated gap between the teeth, are possible, resulting in a correspondingly reduced thinning effect and increased hair-cutting effect. The projections 112, and also the slider 90 and cutting edge attachments 102 in the aforedescribed embodiments, can also be so arranged that the cutting edge 26 of the blade 16 is covered not at each second gap between the teeth, but at each third gap, or even at irregular intervals.

Figure 13:
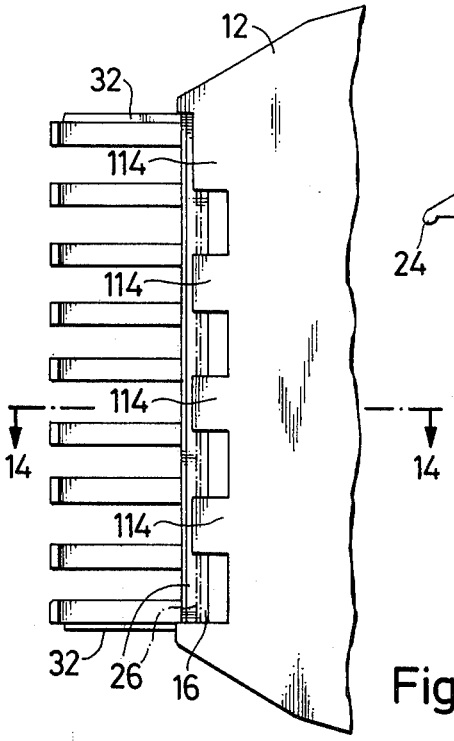
FIG. 13 is a partial view, corresponding to FIG. 7, of a further embodiment of the hair cutter according to the invention.
Figure 14:
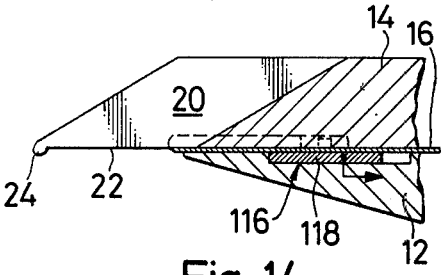
FIG. 14 is a sectional view, taken along the line 14—14 in FIG. 13.

The further embodiment illustrated in FIGS. 13 and 14 differs from the aforedescribed embodiments by the features that the projections 114 disposed in alignment with the gaps between the teeth to be covered are disposed fixed to the baseplate 12, and by being disposed on a displaceable blade-retaining means 116, the blade 16 can be displaced by its cutting edge 46 in front of the front edge of the projections 114 and retracted behind the front edge of the projections 114. In the advanced position shown in continuous lines in the drawing, the blade therefore shortens all the hair it seizes, whereas in the retracted position indicated in chain-dot lines only the hair guided along the blade in the zones in which the cutting edge is not overlapped is shortened (thinning effect).

FIG. 15 is a partial view showing a further embodiment 310 of the hair cutter according to the present invention with the cover plate removed. The cutter 310 has a blade-supporting plate 312 from which a number of rows of narrow teeth 314 with gaps 316, 316' between them project. FIG. 15 shows only one row of teeth, the rest of the cutter being broken away.

Two pins 318 projecting from the blade-supporting plate 312 retain the razor-blade like cutting blade 320. The blade 320 is formed with holes 322 complementary with the pins 318 and can be so inserted into the cutter 310 that one of the two cutting edges 324 lies at choice below the teeth 314.

As can be gathered from FIG. 15, the gaps formed between the teeth 314 are of different depths, a somewhat shorter gap 316' following each deeper or longer gap 316 in the embodiment illustrated in FIG. 15.

When the blade 320 is inserted in the position shown in continuous lines in FIG. 15, in the zone of the shorter gaps 316', the blade cutting edge is overlapped by the material of the cutter closing such gaps at their base, so that in this zone the blade cannot cut, while it is exposed in the longer gaps 316. In contrast, if the blade 320 is adjusted to the position of use shown in chain-dot lines, the cutting 324 is exposed in all the gaps 316, 316', so that this second position corresponds to the hair-cutting position, whereas the position shown in continuous lines corresponds to the thinning function.

Figure 16:
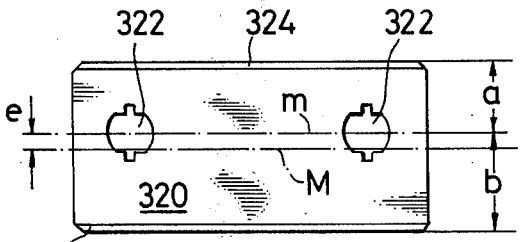
FIG. 16 shows a blade intended for the hair cutter illustrated in FIG. 15.

FIG. 16 shows a blade 320 which can be inserted optionally in the thinning or hair-cutting position. To this end the holes 322 for locating the blades on the pins 318 of the cutter 310 are offset to one side in relation to the central M parallel with the cutting edges 324 only to an extent such that the two blade-insertion positions illustrated in connection with FIG. 15 can be effected by inserting the blade at choice with one or other of the cutting edges 324 in the working position. The eccentric arrangement of the holes 322 in the blade 320 is indicated in FIG. 16 by the different size of the distances *a*, *b*., measured at right angles to the cutting edges, from the cutting edges to the central line *m* laid parallel with them through the centers of the holes 322. The cutting edge 324 shown by the shorter distance *a* is therefore associated with thinning, while the cutting edge 324 aassociated with the distance *b* is used for hair cutting.

The alternative illustrated in FIGS. 17*a* and 17*b* comprises a set of at least two blades 320*a*, 320*b*, the blade 320*a* having a total width 2*a* at right angles to its cutting edges 324*a*, while the corresponding dimension of the blade 320*b* has the reference 2*b*. The holes 322*a*, 322*b* in the blades lie centrally between the associated cutting edges - i.e., the central line *M* of the blades coincides with the central line *m* of the holes.

All that must be done to change over the cutter from thinning to hair cutting, is therefore to substitute the blade 320*b* for the blade 320*a*.

In the case of the hair cutter 410 illustrated in FIG. 18, only one part having a row of teeth is shown, the remainder of the cutter, from which if necessary further rows of teeth can be provided, being broken away. The cutter 410 has two plates, 412, 414 which can be clamped together and between which the blade or blades 416 are so inserted that the blade cutting edge 418 is exposed. In FIG. 18 the plate 412 is covered by the plate 414 and cannot therefore be seen. The blade 416 is also retained in its position in relation to the plate 412 by pins (not shown) projecting from the plate 412, from which a row of narrow teeth 422 having gaps 420 between them project in the zone of the blade cutting edge 418.

The plate 414 can be displaced by guides (not shown) in relation to the plate 412 bearing the row of teeth and therefore to the blade 416, as indicated by the arrow *a'*. In the zone of the cutting edge 418, crenellation-like projections 424 are formed on the plate 414, the front ends of such projections overlapping the cutting edge 418 of the blade 416 in every second gap when the plate 414 is displaced in the direction indicated by the arrow *a'*, the cutting edge remaining exposed in the intermediate gaps between the teeth. In this position, shown in dot-dashed lines, therefore, only that part of the hair which is guided through the gaps free from projections 424 is shortened (thinning). In the position of the plate 414 shown in continuous lines, however, all the hair seized is shortened - i.e., this position is used for hair cutting.

Clearly, the function performed according to the present invention by the displacement of the whole plate 414 can also be effected by a pusher which has crenellations on its front side and is displaceably mounted in a fixed plate 414.

The embodiment illustrated in FIG. 19 differs from the hair cutter described hereinbefore only by the feature that the plate 412 bearing the row of teeth can be displaced relatively to the plate 414 and the blade 416. For this reason the hair cutter 410 illustrated in FIG. 19 is shown from the opposite side in comparison with the cutter illustrated in FIG. 18, so that the plate 412 is visible and the plate 414 covered. The displacement of the plate 412 is again indicated by the arrow *a'*. As can be gathered from FIG. 19, the gaps between the teeth 422 are of different depths, a somewhat shorter gap 420' following each deeper or longer gap 420 in the embodiment illustrated. When the plate 412 is in the position shown in continuous lines in the Figure, the cutting edge of the blade 416 is exposed in all the gaps between the teeth (hair cutting). On the other hand, when the plate 412 is displaced into the position shown in chain-dot lines, the blade cutting edge is covered by the material of the cutter closing such gaps at their base in the zone of the shorter gaps 420' between the teeth, so that in these covered zones the blade cannot cut. The position shown in dot-dashed lines therefore corresponds in this cutter to the thinning position. In this embodiment also the displacement of an extra pusher engaging in the gaps 420' between the teeth to be covered could be substituted for the displacement of the whole plate 412.

While only several embodiments of the present invention have been shown and described, it will be obvious to those skilled in the art that many changes and modifications may be made thereunto without departing from the spirit and scope of the invention.

What is claimed is:

1. A hair cutter comprising:

a blade-supporting plate;

a cover plate;

at least one blade having a blade cutting edge interchangeably retained between said blade-supporting plate and said cover plate; said cover plate having a row of teeth which overlaps said blade cutting edge and being adapted when drawn through the hair to orientate the hair in the manner of a comb perpendicular to said blade cutting edge; one of said plates being displaceable in a direction perpendicular to said blade cutting edge and relative to the other of said plates between two end positions, said blade-supporting plate bears said blade in a region adjacent said cutting edge, yet with said blade cutting edge exposed;

cooperative coupling member means disposed on said plates for fixing said plates in position with relation to one another in selectable displacement positions;

spring means for retaining said coupling member means in positive engagement with one another, one of said plates being formed with an opening;

actuating element means extending through said opening in said one of said plates and being accessible from an outside, and being movably retained perpendicularly to a plane defined by said blade, and engaging one of said coupling member means and upon actuation for disengaging the latter from another of said coupling member means against the force of said spring means;

a slideway having an inner and said cover plate is displaceably mounted in said slideway, and said spring means being operative between said blade supporting plate and said cover plate, at a distance from a cutting edge front end of said cutter beyond said inner end of said slideway, said two plates being forced apart, adjacent said spring means, yet in a zone of said cutting edge of said blade said two plates being forced towards one another clamping said cutting edge of said blade firmly therebetween.

2. A hair cutter as set forth in claim 1 wherein said slideway extends perpendicularly to said blade cutting edge and has on each of lateral outer edges of said cover plate a strip-shaped projection extending up to front ends of said teeth and said slideway is further formed with complementary grooves in opposite side walls of said blade-supporting plate in which said strip-shaped projections are disposed and which receive said cover plate.

3. A hair cutting device comprising:

a blade supporting plate;

a cover plate;

cooperative coupling member means disposed on said plates for fixing said plates in position with relation to one another in selectable displacement positions;

spring means for retaining said coupling member means in positive engagement with one another;

a blade having a cutting edge and said plates releaseably retain the blade therebetween in selectable relative positions, the cover plate being formed with a row of teeth which extend beyond said cutting edge of said blade, the blade supporting plate contacting said blade adjacent said cutting edge thereof but leaving portions of the cutting edge exposed, the blade supporting plate having a wedge-shaped portion extending rearwardly from said cutting edge of the blade so that when the hair cutting device is placed on the hair of a user, the blade may be located at a cutting angle determined by the front ends of the teeth provided on the cover plate and the wedge-shaped portion of the blade supporting plate, the teeth of said row of teeth have front edge portions projecting over said cutting edge of said blade into a plane of said blade by at least the thickness of the blade immediately in front of said cutting edge of said blade when said blade supporting plate and said cover plate are in one end position of said selectable relative positions.

4. A hair cutting device according to claim 3 wherein said front ends of said teeth are formed with rounded end portions extending at an angle to the plane of the cutting blade corresponding to said cutting angle.

5. A hair cutting device according to claim 3 wherein said wedge-shaped portion is formed at least partially of a plurality of knob or pin-like projections, the ends of the knob or pin-like projections defining said wedge-shaped portion.

6. A hair cutting device according to claim 5 wherein the lengths of said knob or pin-like projections increase with increasing distances thereof from the cutting edge of the blade.

7. A hair cutting device according to claim 5 wherein the blade supporting plate is provided with wedge-shaped projections of substantially solid material adjacent the edges thereof, said wedge-shaped projections forming part of said wedge-shaped portion.

8. A hair cutting device according to claim 3 said cooperative coupling means comprising, coupling members, spring biasing means for retaining said coupling member in positive engagement with one another, and an actuating element extending through an opening in one of said plates movably disposed therein perpendicularly relative to said plane of the blade, said actuating element operatively contacting one of said coupling members and adapted to disengage said coupling members on actuation of said actuating element against the biasing of said spring biasing means.

9. A hair cutting device comprising:

a blade supporting plate;

a cover plate;

a blade having a cutting edge and said plates releaseably retain the blade therebetween in selectable relative positions, the cover plate being formed with a row of teeth which extend beyond said cutting edge of said blade, the blade supporting plate contacting said blade adjacent said cutting edge thereof but leaving portions of the cutting edge exposed, the blade supporting plate having a wedge-shaped portion extending rearwardly from said cutting edge of the blade so that when the hair cutting device is placed on the hair of a user, the blade may be located at a cutting angle determined by the front ends of the teeth provided on the cover plate and the wedge-shaped portion of the blade supporting plate, the teeth of said row of teeth have front edge portions projecting over said cutting edge of said blade into a plane of said blade by at least the thickness of the blade immediately in front of said cutting edge of said blade when said blade supporting plate and said cover plate are in one end position of said selectable relative positions, said blade supporting plate being provided with wedge-shaped projections of substantially solid material adjacent the edges thereof, said wedge-shaped projections forming part of said wedge-shaped portion.

10. A hair cutting device comprising:

a blade supporting plate;

a cover plate;

coupling means for locating said blade supporting plate and said cover plate in selectable relative positions;

a blade having a cutting edge and said plates releaseably retain the blade therebetween in selectable relative positions, the cover plate being formed with a row of teeth which extend beyond said cutting edge of said blade, the blade supporting plate contacting said blade adjacent said cutting edge thereof but leaving portions of the cutting edge exposed, the blade supporting plate having a wedge-shaped portion extending rearwardly from said cutting edge of the blade so that when the hair cutting device is placed on the hair of a user, the blade may be located at a cutting angle determined by the front ends of the teeth provided on the cover plate and the wedge-shaped portion of the blade supporting plate, the teeth of said row of teeth have front edge portions projecting over said cutting edge of said blade into a plane of said blade by at least the thickness of the blade immediately in front of said cutting edge of said blade when said blade supporting plate and said cover plate are in one end position of said selectable relative positions, said coupling means comprising, coupling members, spring biasing means for retaining said coupling member in positive engagement with one another, and an actuating element extending through an opening in one of said plates movably disposed therein perpendicularly relative to said plane of the blade, said actuating element operatively contacting one of said coupling members and adapted to disengage said coupling members on actuation of said actuating element against the biasing of said spring biasing means.

11. A hair cutting device according to claim 10 further comprising a slideway formed in said blade supporting plate, said cover plate is mounted within said slideway movable therein perpendicularly relative to said cutting edge of the blade, said cover plate having projecting portions which extend in the direction of displacement of said cover plate as far as said front edges of said teeth provided on the cover plate, said blade supporting plate having formed in opposite side walls thereof complementary grooves, said projecting portions being accommodated in said complementary grooves in said blade supporting plate, said complementary grooves accommodating said cover plate.

12. A hair cutting device according to claim 11 wherein said spring biasing means is operative between said blade supporting plate and said cover plate spaced from said cutting edge of said blade and beyond an inner end of the slideway, such that adjacent said spring biasing means, said plates are forced apart, but adjacent said cutting edge of said blade, said plates are forced towards one another to clamp said blade firmly therebetween.

13. A hair cutting device according to claim 10 wherein said actuating element is formed integrally with one of said coupling members and is retained on said blade supporting plate and is biased by said spring biasing means, said one of said coupling members comprises two projecting portions provided with first catch projections, said cover plate being formed with catch projections operatively engaging with said first catch projections by means of said spring biasing means, said cover plate formed with a slot extending in the direction of displacement of said cover plate with respect to said blade supporting plate, said actuating element extends through said slot.

* * * * *